US007654871B2

(12) United States Patent
Yi et al.

(10) Patent No.: US 7,654,871 B2
(45) Date of Patent: Feb. 2, 2010

(54) ELECTRICAL CONNECTOR WITH ADDITIONAL MATING PORT

(75) Inventors: Chong Yi, Mechanicsburg, PA (US); Kuan-Yu Chen, Harrisburg, PA (US); Pei Tsao, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,131

(22) Filed: Jul. 13, 2009

(65) Prior Publication Data

US 2009/0318026 A1 Dec. 24, 2009

Related U.S. Application Data

(63) Continuation of application No. 12/215,088, filed on Jun. 24, 2008, now Pat. No. 7,559,805.

(51) Int. Cl.
*H01R 24/00* (2006.01)

(52) U.S. Cl. ..... 439/660

(58) Field of Classification Search ..... 439/660, 439/607, 541.5, 580

See application file for complete search history.

(56) References Cited

U.S. PATENT DOCUMENTS

| | | | | |
|---|---|---|---|---|
| 3,986,766 | A | 10/1976 | Sochor | |
| 5,667,393 | A | 9/1997 | Grabbe et al. | |
| 6,062,892 | A | 5/2000 | Meng et al. | |
| 6,334,793 | B1 | 1/2002 | Amoni et al. | |
| 7,354,282 | B2 | 4/2008 | Margulis et al. | |
| 7,467,977 | B1 * | 12/2008 | Yi et al. | 439/607.01 |
| 7,559,805 | B1 * | 7/2009 | Yi et al. | 439/660 |
| 2006/0014431 | A1 | 1/2006 | Shuey et al. | |
| 2007/0049115 | A1 | 3/2007 | Igarashi et al. | |

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector includes an electrical receptacle and an electrical plug for mating with the electrical receptacle. The electrical receptacle includes a first port, a second port communicating with the first port. The second port can accommodate a standard B-type USB 2.0 plug. The first and the second ports can be combined to receive the electrical plug for high-speed signal transmission.

15 Claims, 16 Drawing Sheets

ELECTRICAL CONNECTOR WITH ADDITIONAL MATING PORT

This application is a continuation application of application Ser. No. 12/215,088 filed on Jun. 24, 2008 now U.S. Pat. No. 7,559,805.

BACKGROUND OF THE INVENTION

1. Field of the Invention

The present invention relates to electrical connectors, more particularly to electrical connectors with additional mating ports for mating with corresponding connectors.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient.

FIGS. 13 to 16 show existing USB 2.0 connectors. In FIGS. 13 to 15, this USB connector is a standard B-type USB 2.0 receptacle 300. The USB 2.0 receptacle 300 commonly is an integral part of a host or PC. The USB 2.0 receptacle 300 includes a plug-receiving cavity 31, a receptacle tongue plate portion 32 extending into the cavity 31, a plurality of contacts 33 supported by the receptacle tongue plate portion 32, and a metal shield 34 shielding the cavity 31. The tongue plate portion 32 defines a plurality of passageways (not labeled) for receiving the contacts 33. The contacts 33 are located at opposite sides of the tongue plate portion 32. Each contact 33 includes a convex shaped contact section 331 protruding into the cavity 31 for mating with corresponding plug. The USB 2.0 receptacle 300 further has a pair of beveled portions 35, 36 respectively formed on the upper left corner and the upper right corner of the cavity 31 as best shown in FIG. 14.

FIG. 16 shows a standard B-type USB 2.0 plug 400 for mating with the standard USB 2.0 receptacle 300. The USB 2.0 plug 400 includes a plug insulator 41 defining an opening 42, a plurality of contacts 43 retained in the plug insulator 41, and a metal shell 44 enclosing the plug insulator 41. The plug insulator 41 includes an upper wall 411 and a lower wall 412 with the opening 42 formed therebetween. The contacts 43 are plate-shaped and non-elastic in order to be retained on inner surfaces of the upper and lower walls 411, 412, respectively. The USB 2.0 plug 400 further includes a pair of slant portions 45, 46 located on top lateral sides thereof for mating with the corresponding beveled portions 35, 36 of the USB 2.0 receptacle 300 in order to guide correct insertion of the USB 2.0 plug 400.

Usually, the USB receptacle is mounted on a PCB of a host device such as a personal computer, and the USB plug is connected to a peripheral device such as a mouse for mating with the USB receptacle. However, with some peripheral devices connected by a standard B-type USB connector, it is desired to transmit signals to and from another device directly, without passing though the host device. Under this condition, because one of the peripheral devices must function as a host device, it is necessary to be able to transmit a voltage between relevant peripheral devices to activate the host function.

As discussed above, with limited data transmission speed of the USB 2.0 connectors, there is a need to design electrical connectors with additional mating ports for high-speed signal transmission.

BRIEF SUMMARY OF THE INVENTION

An electrical connector includes an electrical receptacle and an electrical plug for mating with the electrical receptacle. The electrical receptacle includes an insulative housing defining an upper receiving cavity, a lower receiving cavity communicating with the upper receiving cavity, an upper tongue portion extending into the upper receiving cavity and a lower tongue portion extending into the lower receiving cavity. A plurality of non-elastic first contacts are disposed on a lower surface of the upper tongue portion. A plurality of deformable second contacts are disposed on opposite upper and lower surfaces of the second tongue portion and protrude into the lower receiving cavity. The upper and the lower tongue portions are parallel to each other among which the lower tongue portion is much thicker than the upper tongue portion. The lower receiving cavity can be independently used for receiving a first insertion connector, and the upper and the lower receiving cavities can be jointly used for receiving a second insertion connector expanded from the first insertion connector.

An electrical plug includes a frame-shaped insulator defining a lower mating cavity and a metal shell enclosing the insulator to form an upper mating cavity. The upper mating cavity is narrower than the lower mating cavity, and the upper and the lower mating cavities are separated by a separated plate formed on the insulator. The separate plate includes an upper mating surface through which a plurality of first passageways are defined and a lower mating surface. The metal shell defines a slant portion substantially located at its middle position and also located adjacent to the lower mating cavity. A plurality of first plug contacts include elastic first contacting sections deformably received in the first passageways and resistance ends extending from the first contacting sections under a condition that the resistance ends are always located below the upper mating surface in order to prevent the first contacting sections from over-extension beyond the upper mating surface. A plurality of second plug contacts include stiff second contacting sections disposed on the lower mating surface of the separated plate and exposed to the lower mating cavity.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Within the following description, a standard USB 2.0 connector, receptacle, plug, and signaling all refer to the USB architecture described within the Universal Serial Bus Specification, 2.0 Final Draft Revision, Copyright December, 2002, which is hereby incorporated by reference herein.

Figure 10:
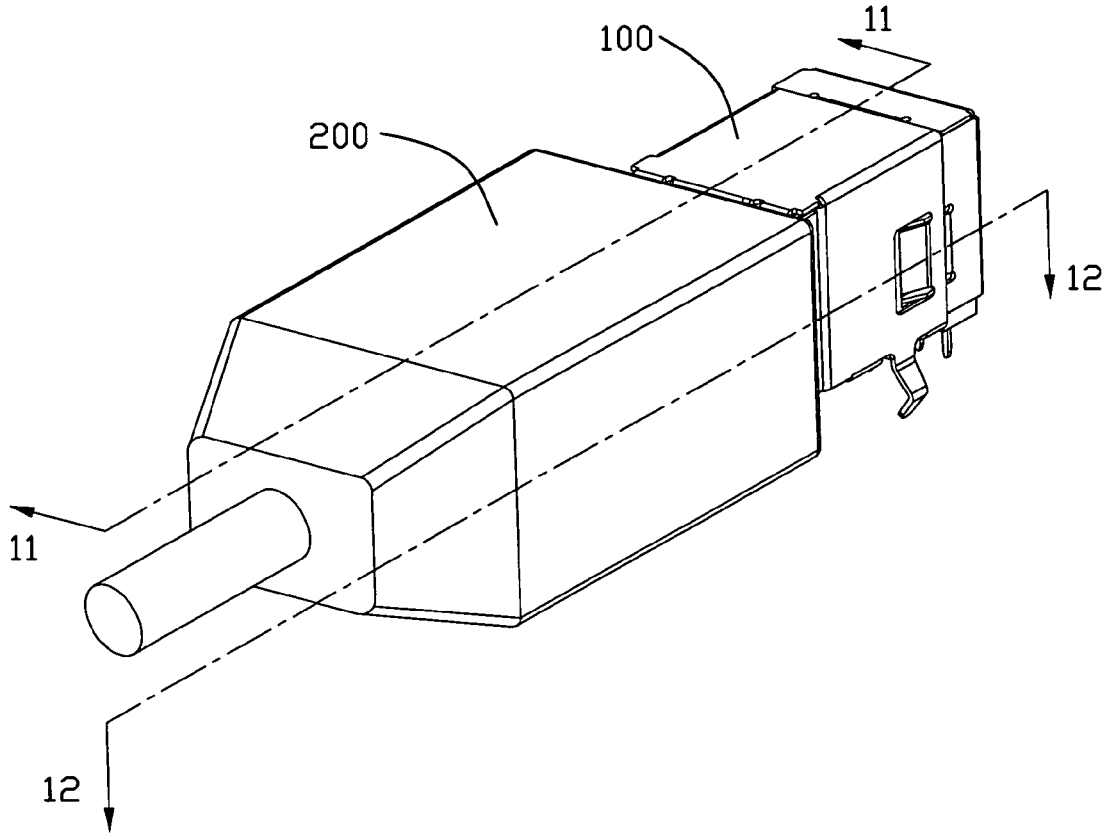
FIG. 10 is a perspective view of the electrical plug and receptacle, showing a state that the electrical plug is fully inserted into the electrical receptacle.

Referring to FIG. 10, an electrical connector of the preferred embodiment includes an electrical receptacle 100 and an electrical plug 200 for mating with the electrical receptacle 100. The electrical receptacle 100 is mounted on a Printed Circuit Board (PCB, not shown) and includes an insulative housing 1, a plurality of first and second contacts 2, 3 retained in the insulative housing 1, a pair of power contacts 24 and a metal shield 4 enclosing the insulative housing 1 for EMI protection.

Figure 1:
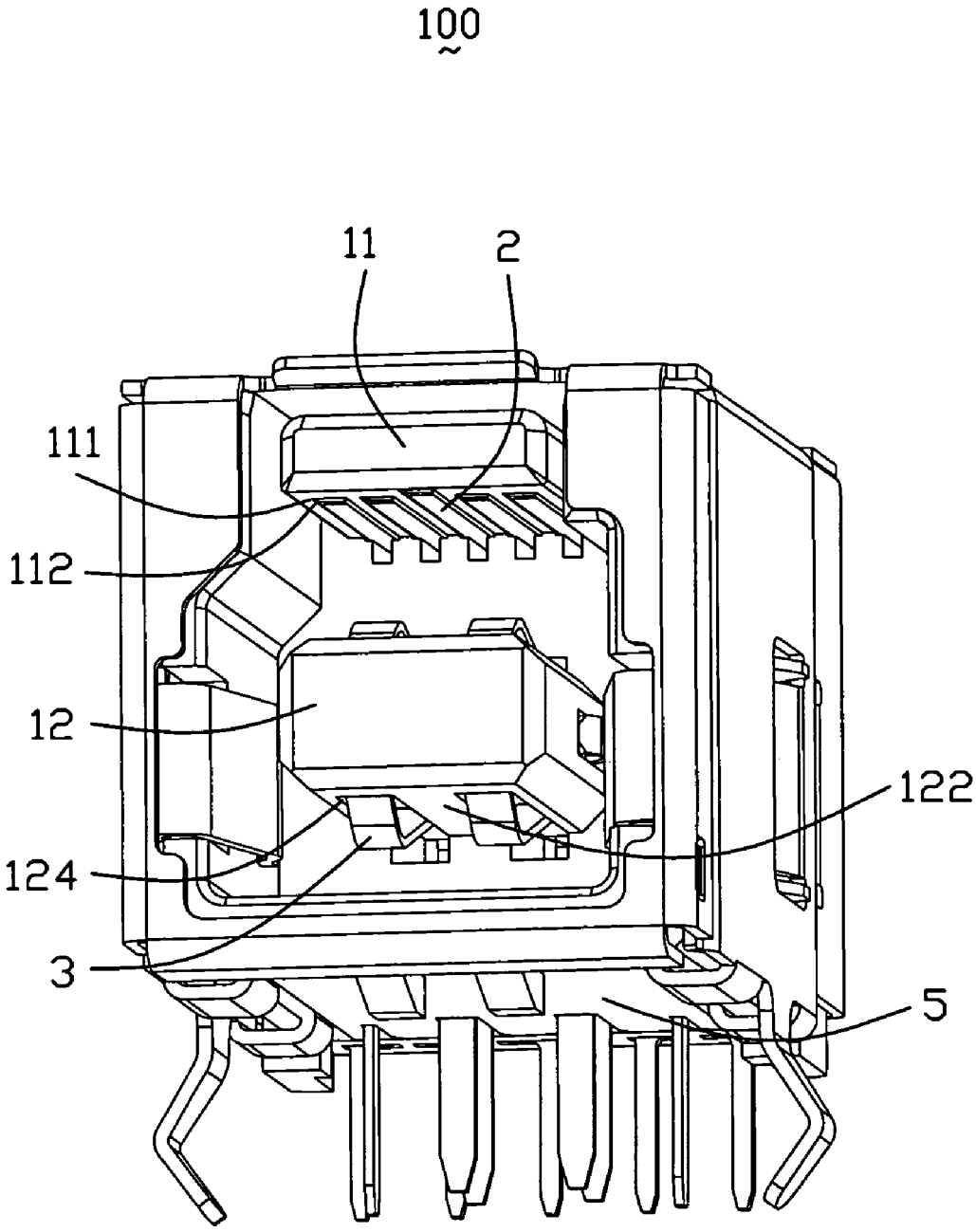
FIG. 1 is a perspective view of an electrical receptacle according to a preferred embodiment of the present invention.
Figure 2:
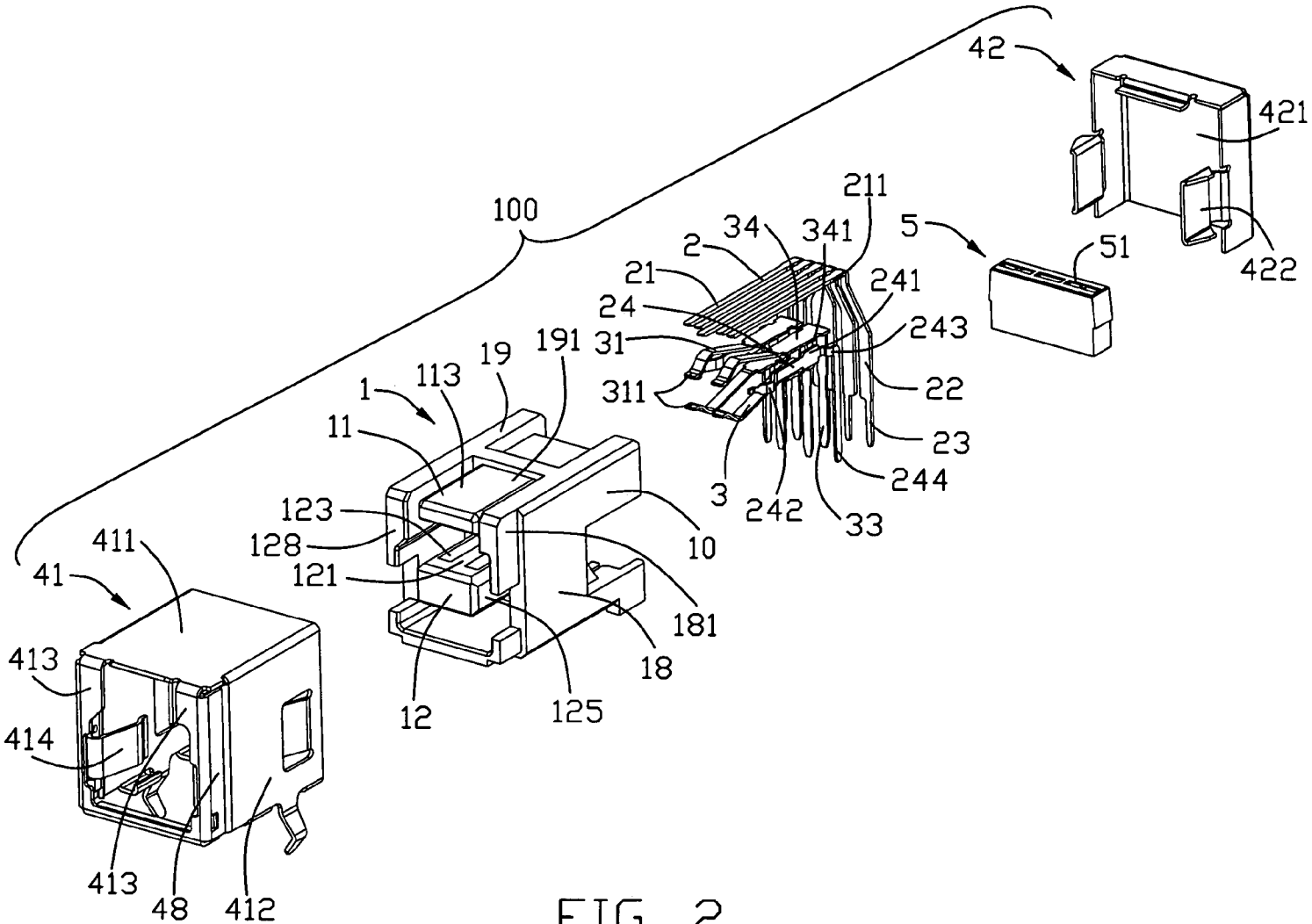
FIG. 2 is an exploded perspective view of the electrical receptacle.
Figure 3:
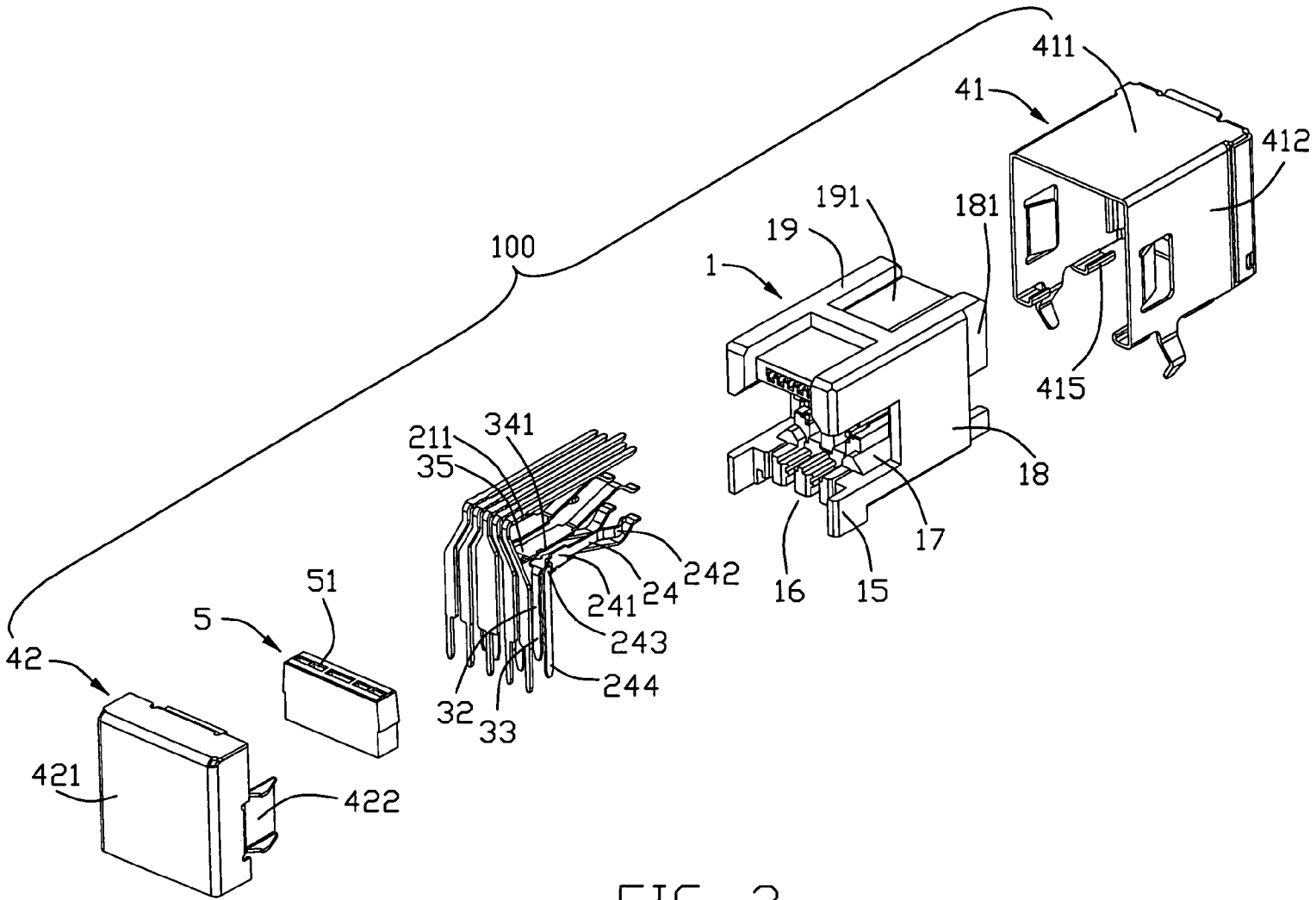
FIG. 3 is another exploded perspective view of the electrical receptacle, but taken from another aspect.
Figure 4:
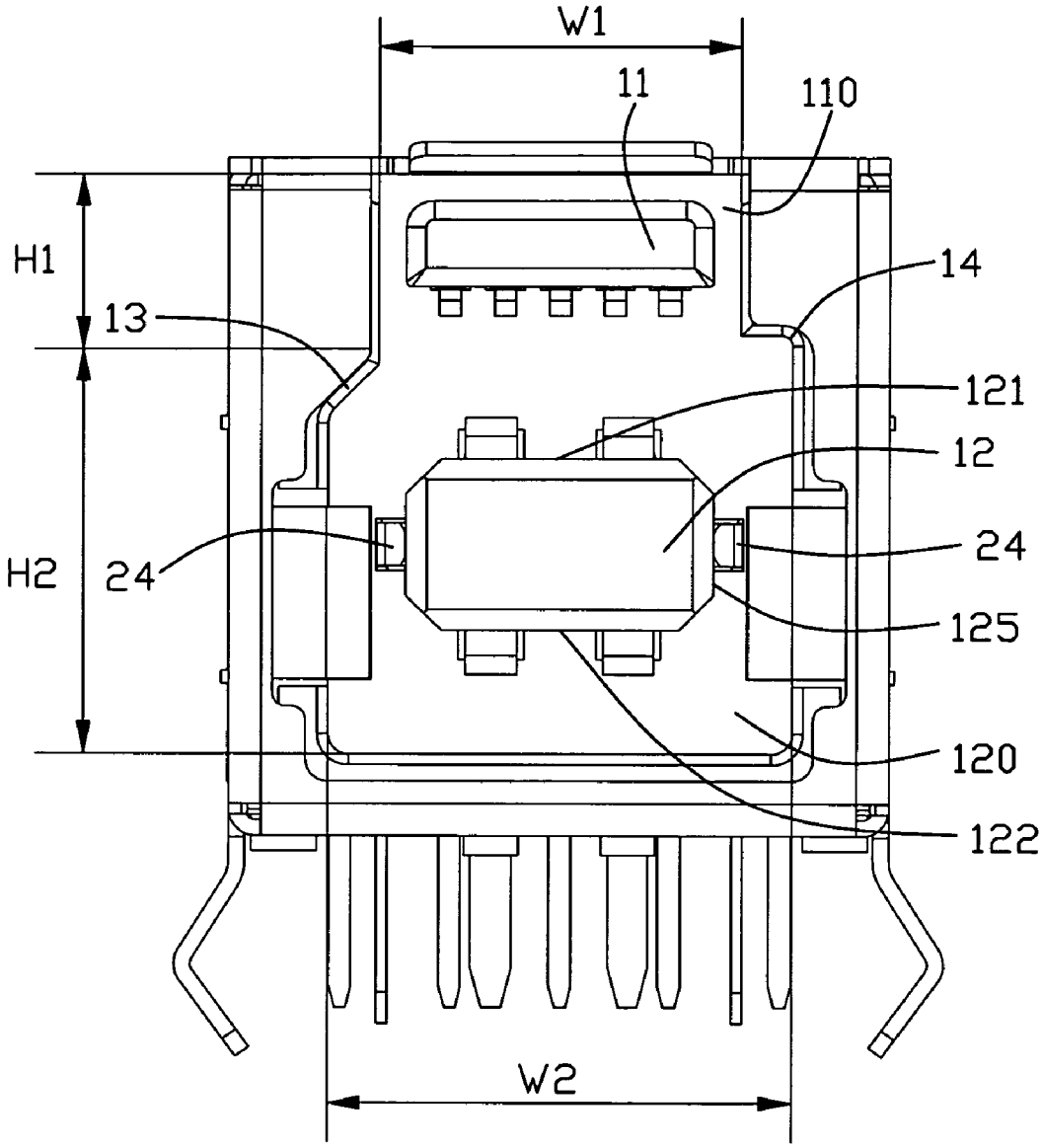
FIG. 4 is a front view of the electrical receptacle shown in FIG. 1.
Figure 9:
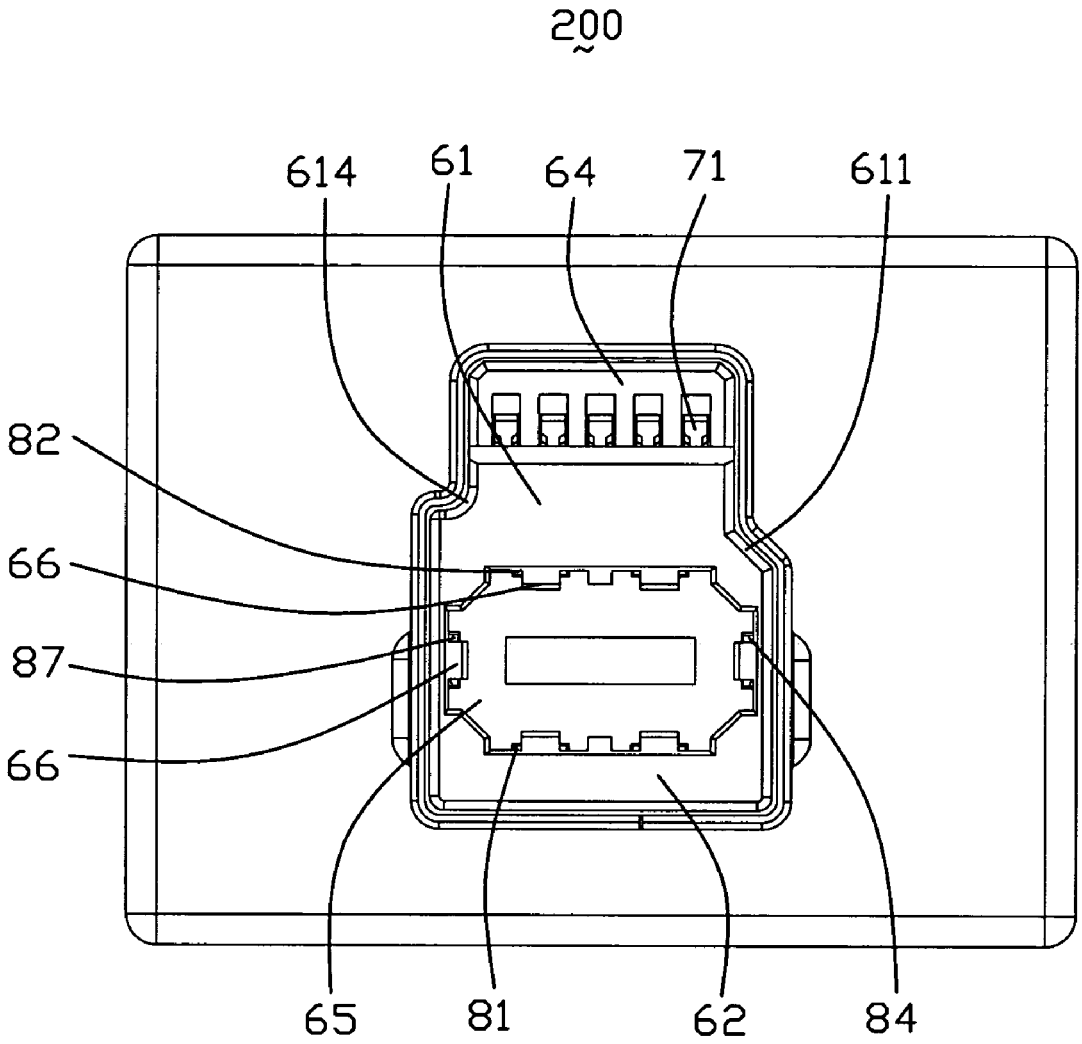
FIG. 9 is a front view of the electrical plug shown in FIG. 6.
Figure 12:
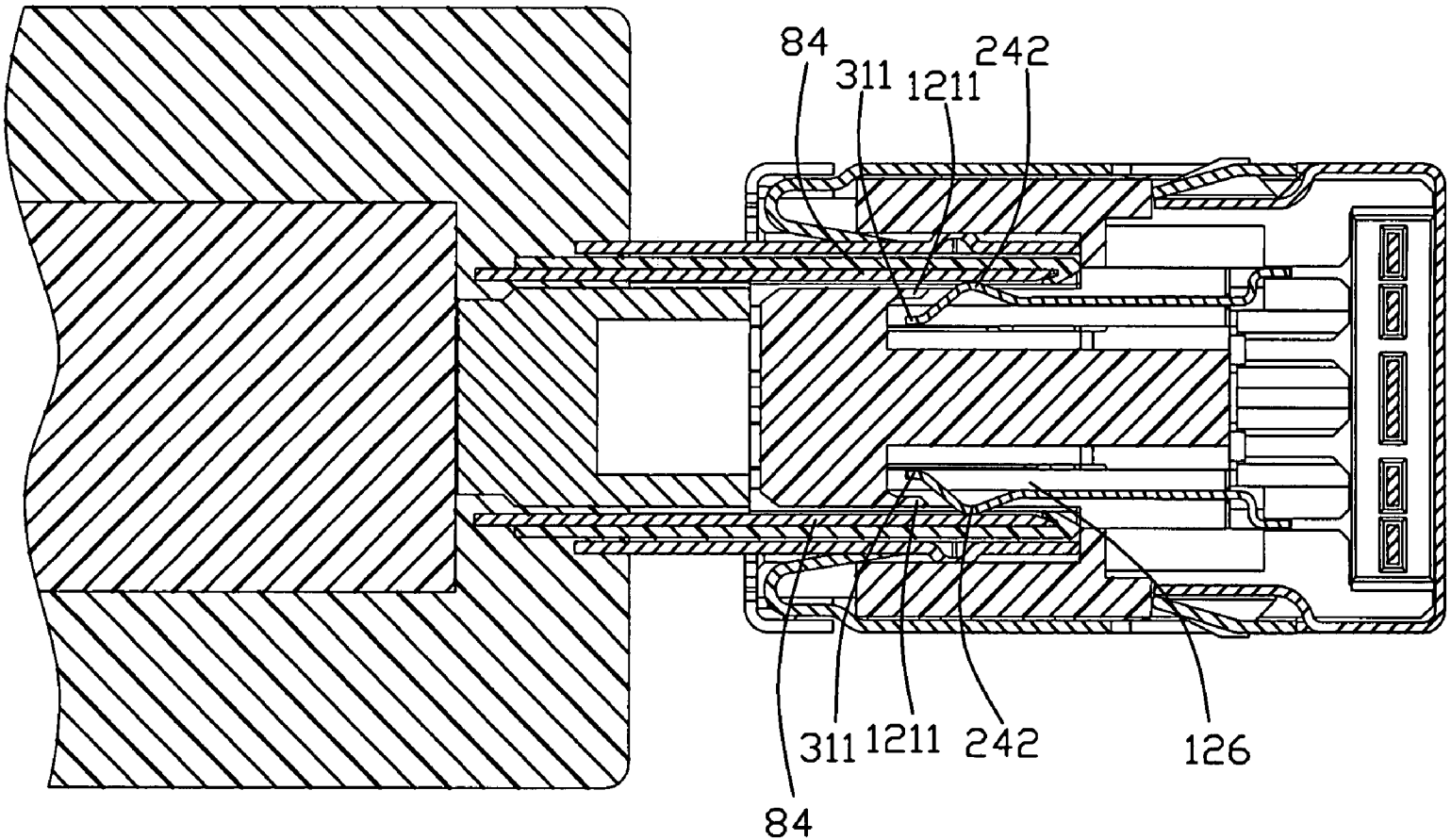
FIG. 12 is a cross-sectional view of the electrical plug and receptacle taken along line 12-12 of FIG. 10, showing power contacts mating with each other.
Figure 13:
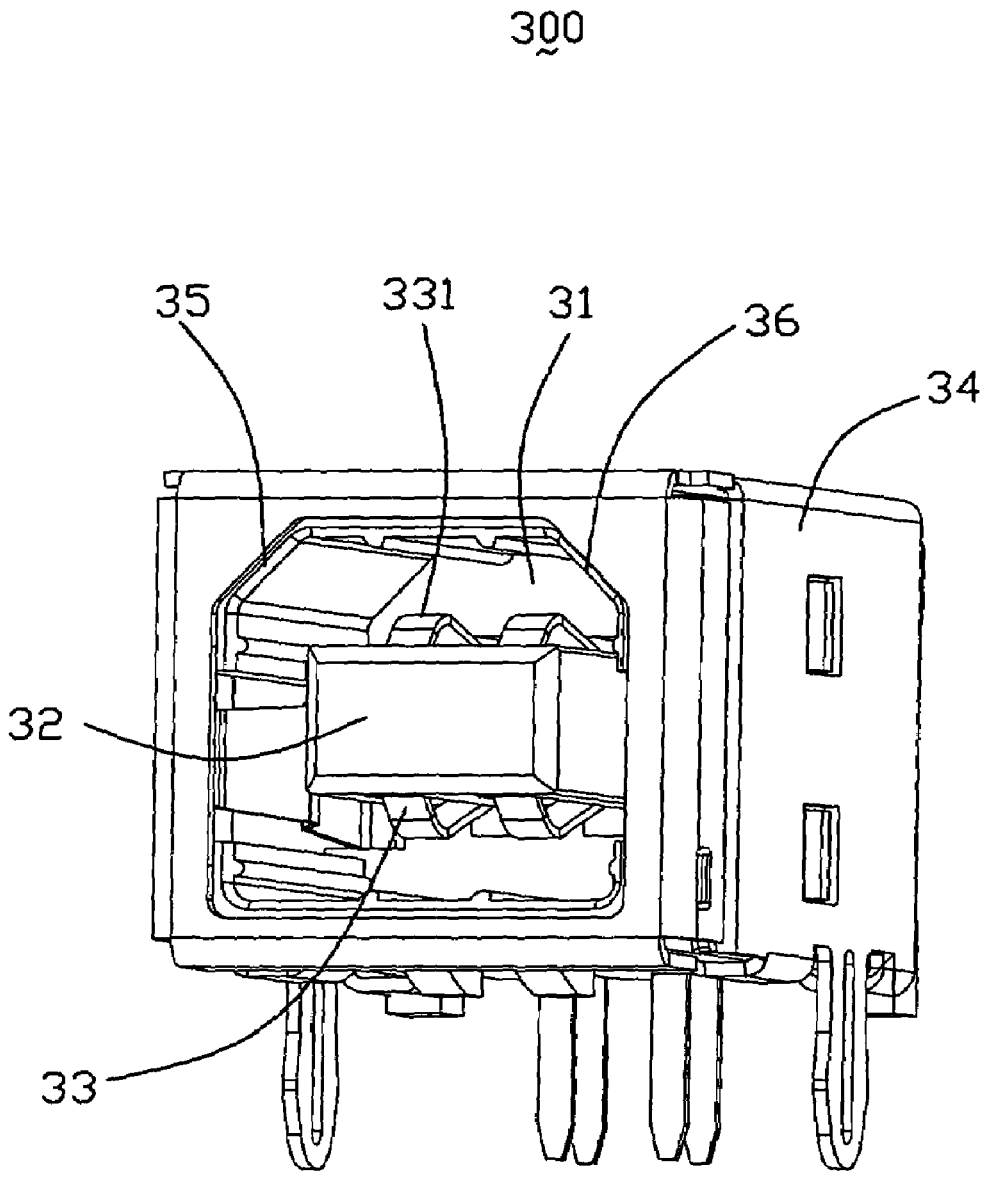
FIG. 13 (PRIOR ART)
FIG. 13 is a perspective schematic view of a standard B-type USB 2.0 receptacle.
Figure 14:
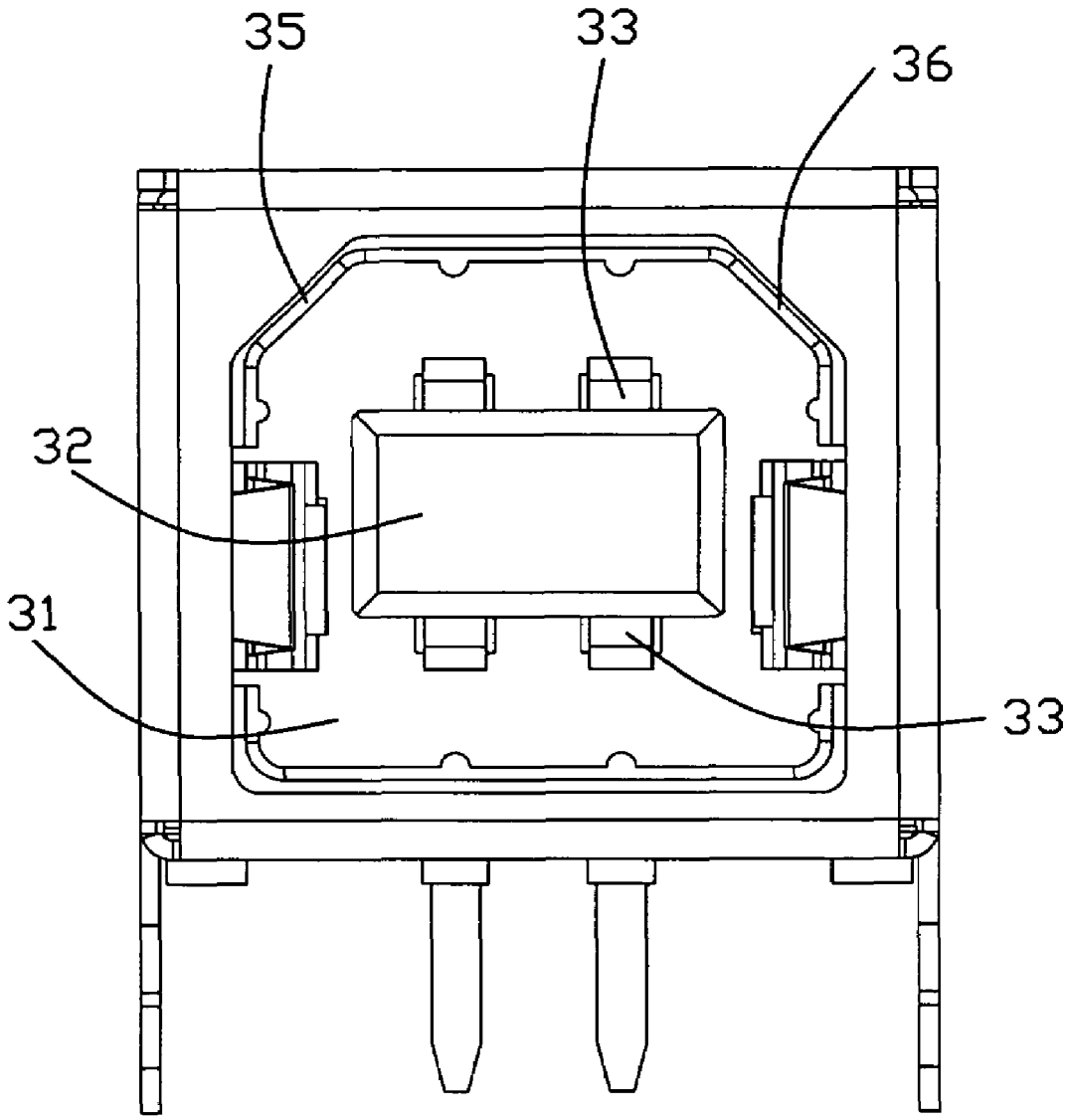
FIG. 14 (PRIOR ART)
FIG. 14 is a front view of the standard B-type USB 2.0 receptacle shown in FIG. 13.
Figure 16:
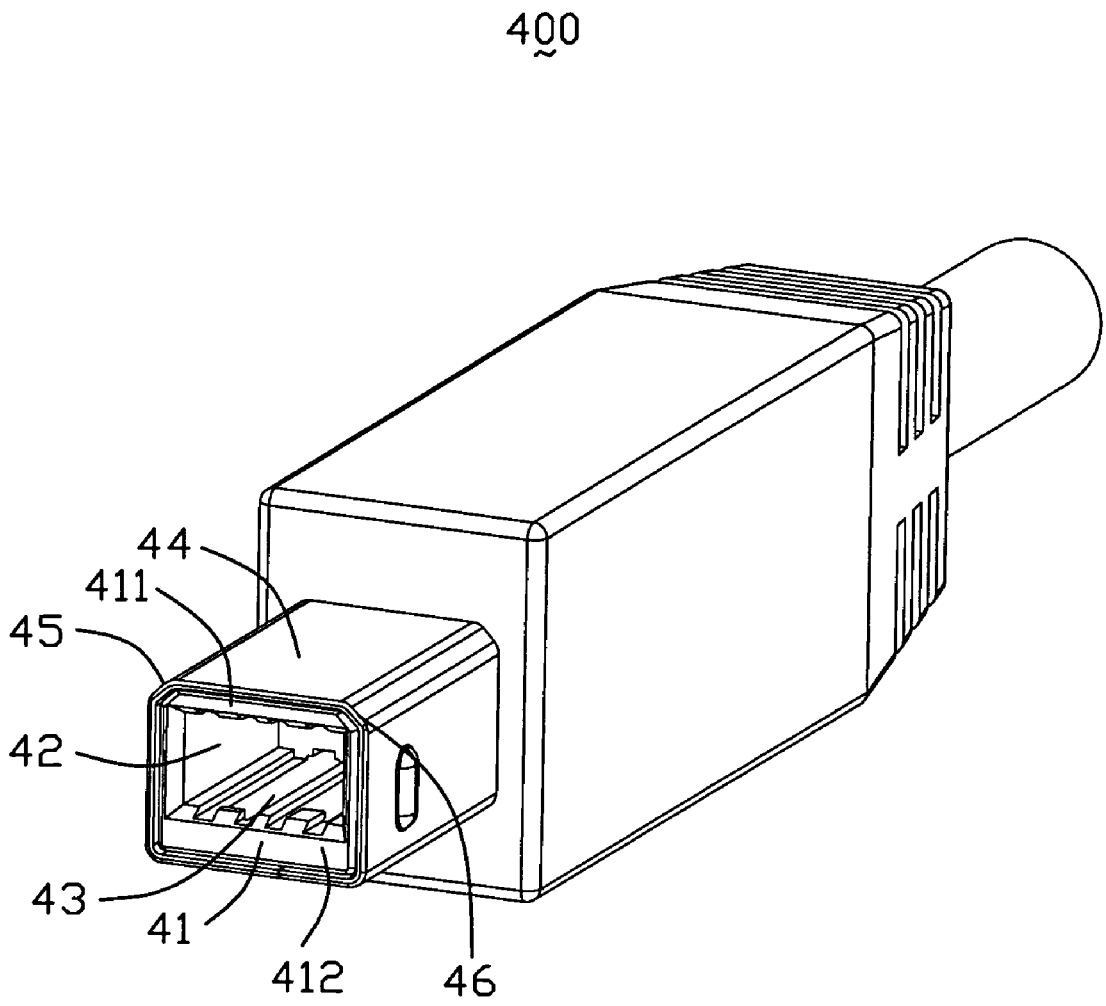
FIG. 16 (PRIOR ART)
FIG. 16 is a perspective view of a standard B-type USB 2.0 plug.

Referring to FIGS. 1-4, the insulative housing 1 is formed by plastic injection molding to have a base portion 10, a pair of first and second tongue portions 11, 12 extending forwardly from the base portion 10, and a pair of side extensions 18 located at lateral sides of the first and second tongue portions 11, 12. The insulative housing 1 defines a first receiving cavity 110 with the first tongue portion 11 extending thereinto, and a second receiving cavity 120 with the second tongue portion 12 extending thereinto. The first and the second receiving cavities 110, 120 communicate with each other wherein the second receiving cavity 120 is much larger than the first receiving cavity 110. As shown in FIG. 4, the first and the second receiving cavities 110, 120 are upper and lower cavities, respectively. The first and the second receiving cavities 110, 120 extend through a front mating surface 128 of the insulative housing 1. In detail, as shown in FIG. 4, the width W2 of the second receiving cavity 120 is larger than the width W1 of the first receiving cavity 110. The height H2 of the second receiving cavity is also larger than the height H1 of the first receiving cavity 110. The first receiving cavity 110 is substantially rectangular shaped. The insulative housing 1 has a chamfered portion 13 and a right angle portion 14 located at an upper left corner and an upper right corner of the second receiving cavity 120. The right angle portion 14 and the chamfered portion 13 are located between the first and the second tongue portions 11, 12 along a vertical direction as shown in FIG. 9. The chamfered portion 13 and right angle portion 14 act as keys for regulating the insertion orientation of the electrical plug 200 or the standard B-type USB 2.0 plug as shown in FIG. 16. In the preferred embodiment of the present invention, the first and the second tongue portions 11, 12 are stacked in a vertical direction. The first tongue portion 11 is an upper one and the second tongue portion 12 is a lower one. The first tongue portion 11 includes a plurality of grooves 112 recessed from a mounting surface 111 thereof. The grooves 112 further extending backwardly through the base portion 10 for receiving the first contacts 2. The second tongue portion 12 is much thicker than the first tongue portion 11 along the vertical direction as best shown in FIG. 4. The second tongue portion 12 includes opposite first and second walls 121, 122 on upper and lower sides thereof, and a pair of side walls 125 connecting the first and the second walls 121, 122. The first and the second walls 121, 122 define a pair of passageways 123, 124, respectively. The passageways 123, 124 further extending backwardly through the base portion 10 for receiving the second contacts 3. The first and the second walls 121, 122 respectively define a plurality of pressing plates 1211 extending into the passageways 123, 124 for mating with the second contacts 3. The mounting surface 111 is a lower surface of the first tongue portion 11 so that the mounting surface 111 is much closer to the first wall 121 than to the second wall 122. That is to say, the mounting surface 111 directly faces the first wall 121. Each side wall 125 defines a depression 126 (as shown in FIG. 12) for receiving the power contacts 24 as shown in FIGS. 4 and 12. As shown in FIGS. 2&3, each side extension 18 has a front contracted section 181 for abutting against the metal shield 4. The insulative housing 1 further includes a top surface 19 and a depression 191 downwardly defined through the top surface 19. The depression 191 extends through the front mating surface 128 so as to expose the first tongue portion 11. The first tongue portion 11 defines an upper surface 113 opposite to the mounting surface 111 under a condition that the upper surface 113 is lower than the top surface 19. As shown in FIG. 3, the base portion 10 includes a pair of cantilevered wings 15 extending backwardly, a receiving slot 16 formed between the wings 15, and a rear chamber 17 over the receiving slot 16. The rear chamber 17 is located at the rear of the second tongue portion 12 and communicates with the receiving slot 16 for accommodating the second contacts 3.

The first contacts 2 of the preferred embodiment are non-elastic. Each first contact 2 comprises a plate-shaped stiff contact portion 21, a first mounting portion 22 bending downwardly from the contact portion 21 and a tail portion 23 formed a distal end of the first mounting portion 22. The contact portions 21 and the first mounting portions 22 are located at horizontal and vertical planes, respectively. As shown in FIGS. 3&4, the tail portions 23 are contracted compared with the first mounting portions 22. The contact portions 21 are received in the grooves 111 of the first tongue portion 11 so that they can be exposed to the first receiving cavity 110 for mating with the electrical plug 200. Each contact portion 21 has a plurality of barbs 211 for interferentially abutting against the corresponding groove 111 so that the contact portions 21 can be stably fixed in the grooves 111. As best shown in FIG. 1, the first contacts 2 of the preferred embodiment includes a middle grounding contact and two pairs of first and second signal contacts respectively disposed on lateral sides of the grounding contact. The grounding contact attached on the mounting surface 111 of the first tongue portion 11 is longer than that of the first or the second signal contact so that the front end of the grounding contact is much closer to a free end of the first tongue portion 11. With insertion of the electrical plug 200, the electrical plug 200 contacts the grounding contact first and then contacts the first and second signal contacts for better grounding protection.

The second contacts 3 of the preferred embodiment are elastic. Each second contact 3 comprises a convex shape elastic contact section 31, a fastening portion 34 extending backwardly from the contact section 31, a second mounting portion 32 bending downwardly from the fastening portion 34 and a tail section 33 on a distal end of the second mounting portion 32. The contact sections 31 are located on the passageways 123, 124 of the second tongue portion 12 and extend beyond the first and the second walls 121, 122 to protrude into the second receiving cavity 120. The fastening portion 34 has a plurality of barbs 341 for interferentially abutting against the corresponding passageways 123, 124 so that the fastening portion 34 can be stably fixed in the passageways 123, 124. Each contact section 31 includes an extension end 311 always located under the pressing plate 1211 so that the contact sections 31 can be protected from over-extension beyond the passageways 123, 124. Each second contact 3 further includes a transition portion 35 formed by the second mounting portion 32 and the fastening portion 34 for being received in the rear chamber 17.

Each power contact 24 of the preferred embodiment includes a retaining portion 241, a convex shape elastic contact section 242 extending forwardly from the retaining portion 241 and a soldering portion 244 extending downwardly from the retaining portion 241. Each power contact 24 further includes an offset portion 243 extending outwardly from the retaining portion 241 so that the retaining portion 241 and the soldering portion 244 are located at different planes. The retaining portions 241 are partly retained in the corresponding depressions 126 of the second tongue portion 12. The contact sections 242 sidewardly protrude into the second receiving cavity 120 for mating with the electrical plug 200 as best shown in FIG. 12.

Figure 5:
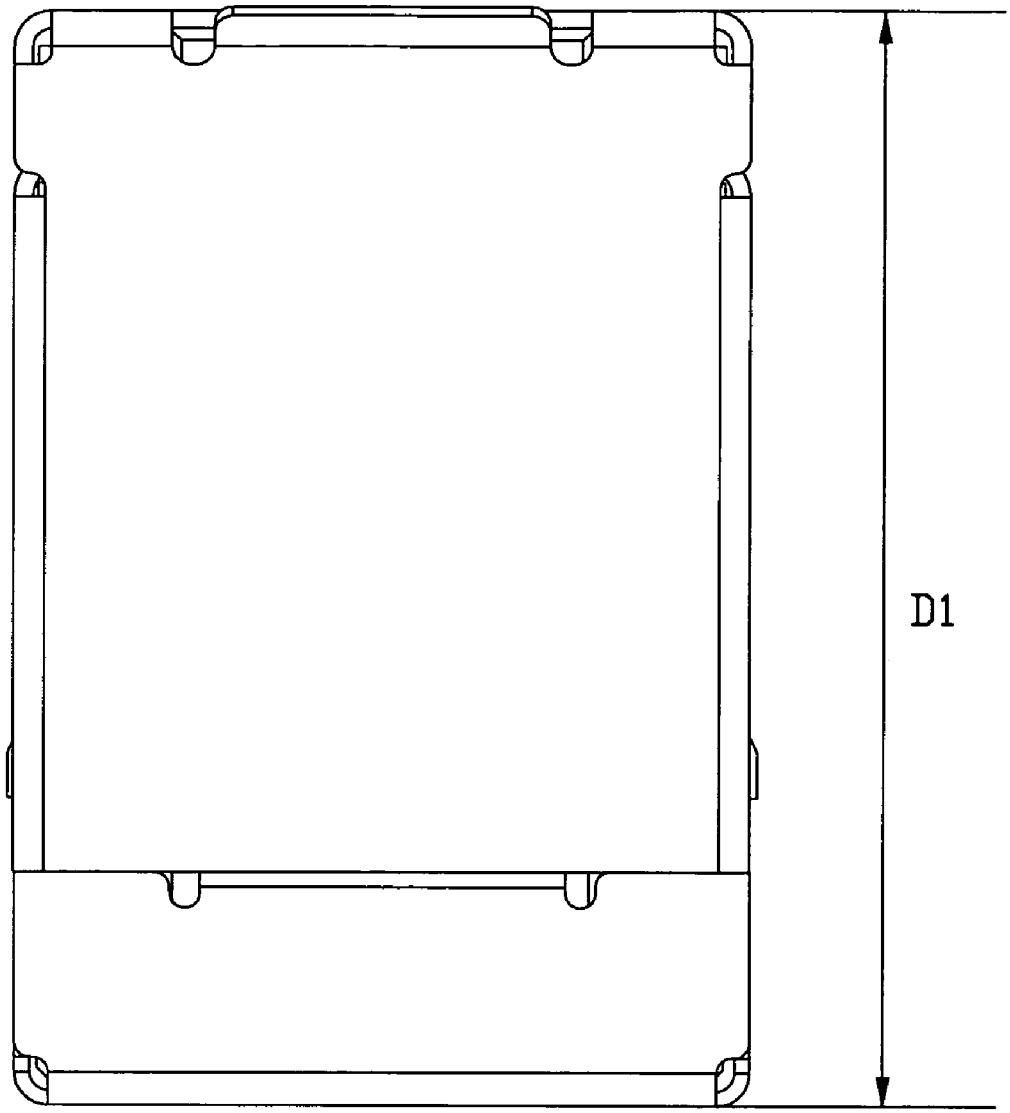
FIG. 5 is a top view of the electrical receptacle shown in FIG. 1.
Figure 6:
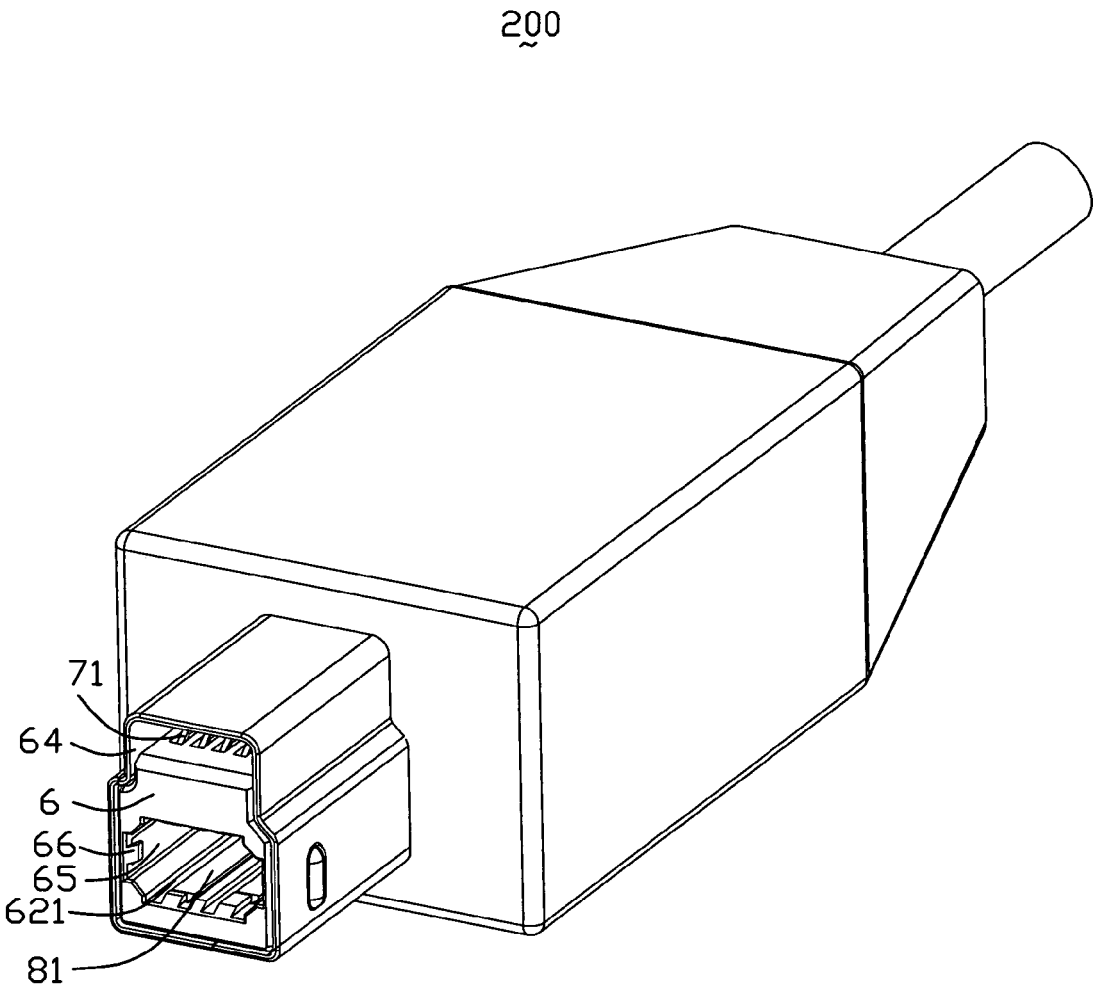
FIG. 6 is a perspective view of an electrical plug which can be inserted into the electrical receptacle.
Figure 15:
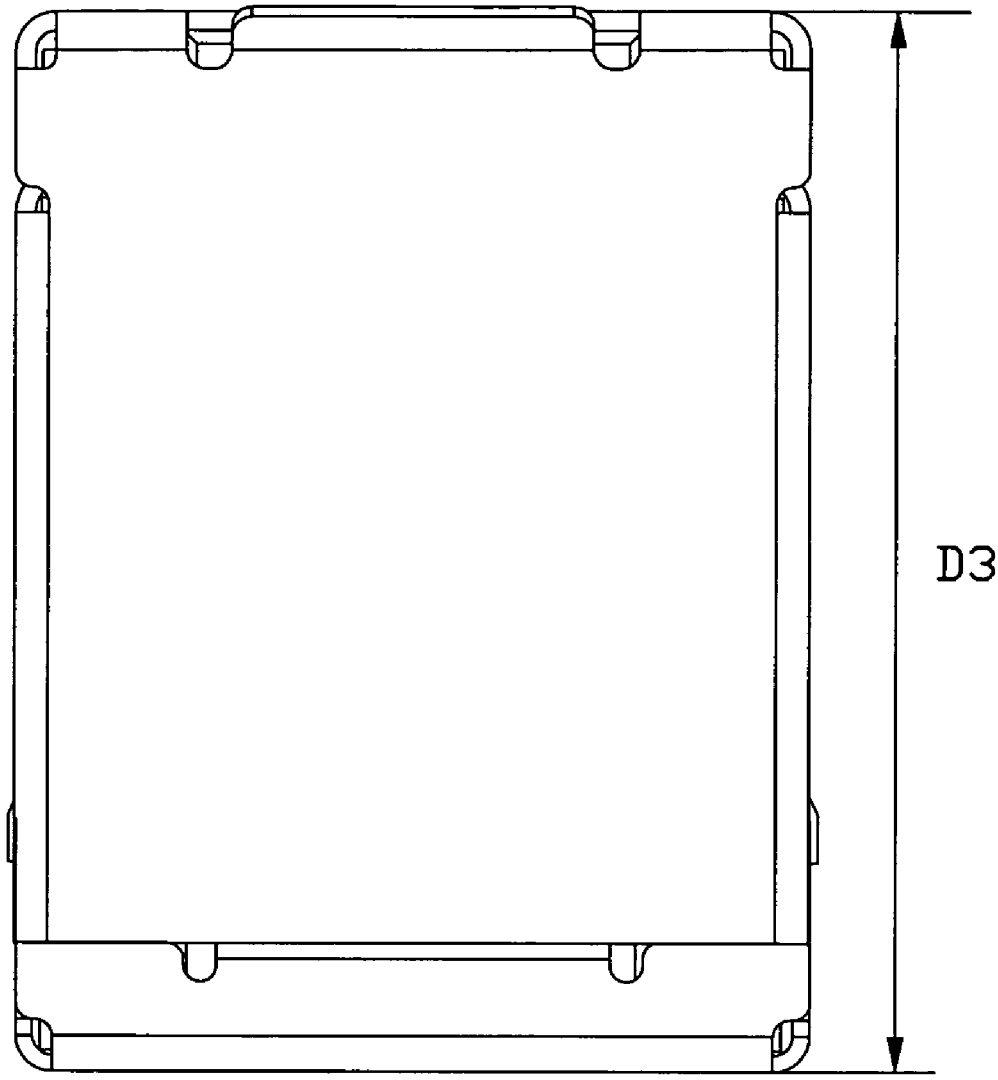
FIG. 15 (PRIOR ART)
FIG. 15 is a top view of the standard B-type USB 2.0 receptacle shown in FIG. 13.

In assembly, the first mounting portions 22 of the first contacts 21 are located on peripheral side of the second mounting portions 32 of the second contacts 3 so that the depth D1 of electrical receptacle 100 is much larger than the corresponding depth D3 of the existing B-type USB 2.0 receptacle 300 as shown in FIGS. 5 and 15.

The electrical receptacle 100 includes a lower port compatible to the existing standard B-type USB 2.0 plug shown in FIG. 16 and an additional upper port for transmitting high-speed signals in order to improve the transmission speed. The upper and the lower ports are simultaneously combined to receive the electrical plug 200. It is obvious that the whole height of the electrical receptacle 100 is much larger than that of the standard B-type USB 2.0 receptacle because of the existing of the upper port.

In order to organize the tail portions 23, the electrical receptacle 100 includes a spacer 5 received in the receiving slot 16 of the insulative housing 1. The spacer 5 defines a plurality of through holes 51 for the first mounting portions 22 extending therethrough. The tail portions 23 downwardly extend beyond the spacer 5 for being easily mounted to the PCB.

The metal shield 4 includes a front metal shield 41 enclosing the insulative housing 1, a rear metal shield 42 attached to the front metal shield 41. The front metal shield 41 is stamped from a unitary one-piece metal sheet to have a top wall 411, a pair of side walls 412, a front contracted portion 48 which includes a pair of front walls 413 bending inwardly from front ends thereof. Each side wall 412 includes an engaging arm 414 extending into the second receiving cavity 120 for abutting against the electrical plug 200 or the standard B-type USB 2.0 plug 400. Each side wall 414 further includes a plurality of supporting portions 415 abutting against the spacer 5 so that the spacer 5 can be firmly fixed to the insulative housing 1. In assembly, the side walls 412 are attached to the side extensions 18 and the front contracted portion 48 abuts against the front contracted section 181 of the insulative housing 1. The rear metal shield 42 includes a rear wall 421 attached to the insulative housing 1 and a pair of arms 422 abutting against the side wall 412 of the front metal shield 41.

Figure 7:
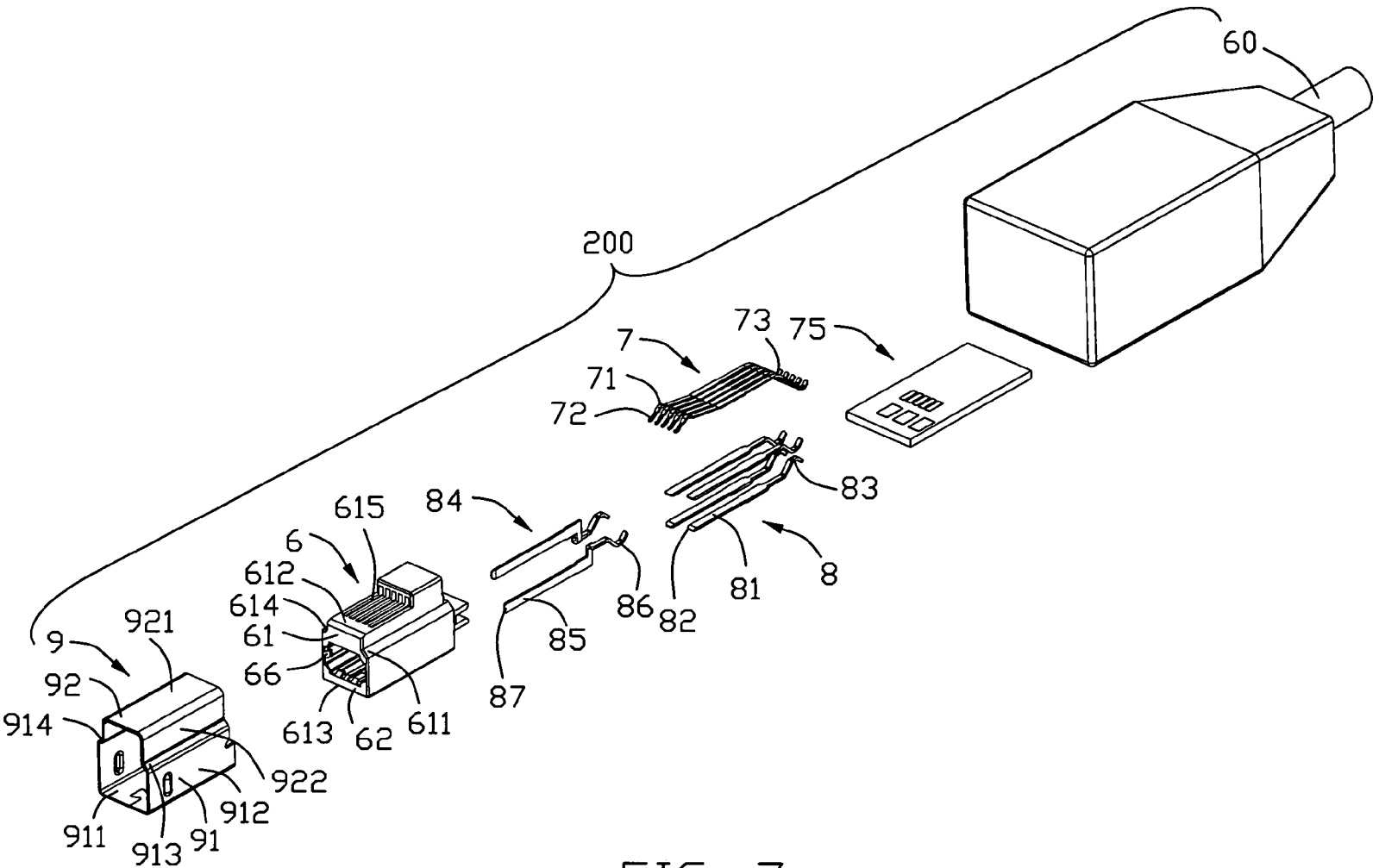
FIG. 7 is an exploded perspective view of the electrical plug.
Figure 8:
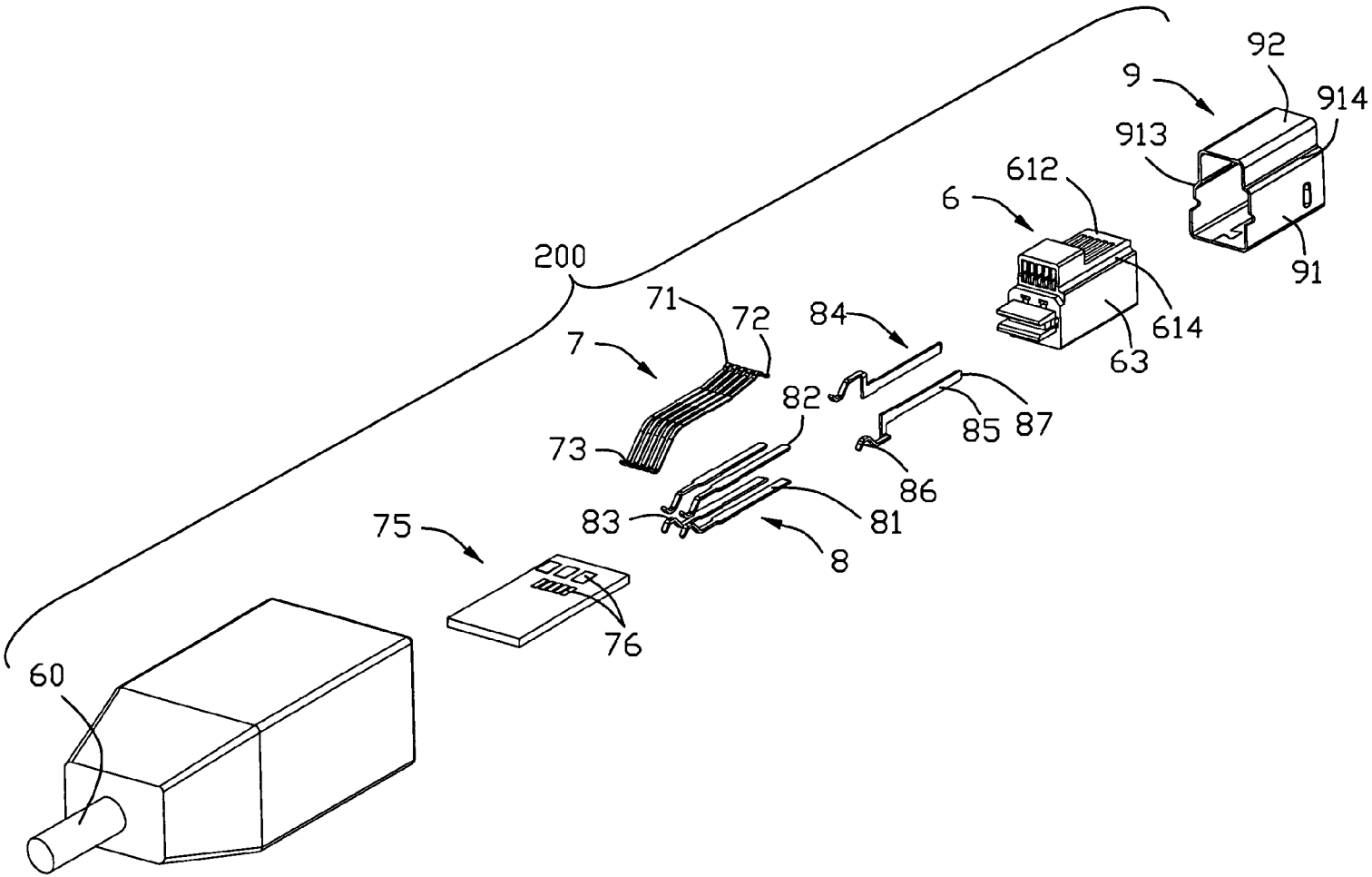
FIG. 8 is another exploded perspective view of the electrical plug, while taken from another aspect.

The electrical plug 200 includes an insulator 6, a plurality first and second plug contacts 7, 8 retained in the insulator 6, a pair of plug power contacts 84, a metal shell 9 enclosing the insulator 6, an inner PCB 75 and a cable 60 electrically connecting with the first and the second plug contacts 7, 8 as well as the plug power contacts 84. The insulator 6 is frame-shaped and includes an upper separate plate 61, a bottom portion 62 opposite to the separate plate 61 and a pair of side portions 63 connecting the separate plate 61 and the bottom portion 62. The metal shell 9 has a lower portion 91 and an upper portion 92 narrower than the lower portion 91. The upper portion 92 includes a top wall 921 and a pair of first side walls 922. The lower portion 91 includes a bottom wall 911 attached to the bottom portion 62 of the insulator 6, and a pair of second side walls 912 attached to the side portions 63 of the insulator 6. The separate plate 61 includes a slant portion 611 and a substantial right angle portion 614 on lateral sides thereof as shown in FIG. 9. The second side walls 912 comprise a corresponding slant section 913 and a corresponding right angle section 914 attached to the slant portion 611 and the substantial right angle portion 614 for mating with the chamfered portion 13 and right angle portion 14 of the electrical receptacle 100. A first opening 64 is enclosed by the top wall 921, a pair of first side walls 922 and the separate plate 61. The insulator 6 defines a second opening 65 enclosed by the separate plate 61, the pair of side portions 63 and the bottom portion 62. That is to say the first and the second openings 64, 65 are separated by the separate plate 61 which includes a first side 612 exposing to the first opening 64 and a second side 613 exposing to the second opening 65. The second opening 65 is much bigger than the first opening 64 both in height and width as best shown in FIG. 9. The first side 612 defines a plurality of first passageways 615 for receiving the first plug contacts 7. The separate plate 61, the bottom portion 62 and the pair of side portions 63 each includes a block 66 protruding into the second opening 65 for position distal ends 82, 87 of the second plug contacts 8 and the plug power contacts 84. The first plug contacts 7 are elastic and include elastic engaging sections 71 deformably received in the first passageways 615, resistance ends 72 extending forwardly from the engaging sections 71 and curved first mounting sections 73 extending backwardly from the engaging sections 71. The engaging sections 71 extend into the first opening 64 for abutting against the contact portions 21 of first contacts 2. The resistance ends 72 are located at distal ends of the engaging sections 71 and are always located below an upper mating surface of the first side 612 in order to prevent the engaging sections 71 from over-extension beyond the upper mating surface. The second plug contacts 8 are attached to the second side 613 of the separate plate 61 and an inner side 621 of the bottom portion 62, respectively. The second plug contacts 8 include plate-shaped stiff mating sections 81 exposed to the second opening 65 for abutting against the elastic contact sections 31 of the second contacts 3 and curved second mounting sections 83 which is contracted compared with the elastic contact sections 31 as best shown in FIG. 7. Each plug power contact 84 includes a stiff contact portion 85 for abutting against the corresponding contact section 242 of the electrical receptacle 100 and a curved third mounting sections 86 extending from the contact portion 85. The contact portions 85 of the plug power contacts 84 are attached to inner sides of the side portions 63 and exposed to the second opening 65. In the preferred embodiment of the present invention, the first and the second plug contacts 7, 8 as well as the plug power contacts 84 are electrically connected to the cable 60 via the first, second and the third mounting sections 73, 83, 86 pressing against golden fingers 76 of the inner PCB 75.

Figure 11:
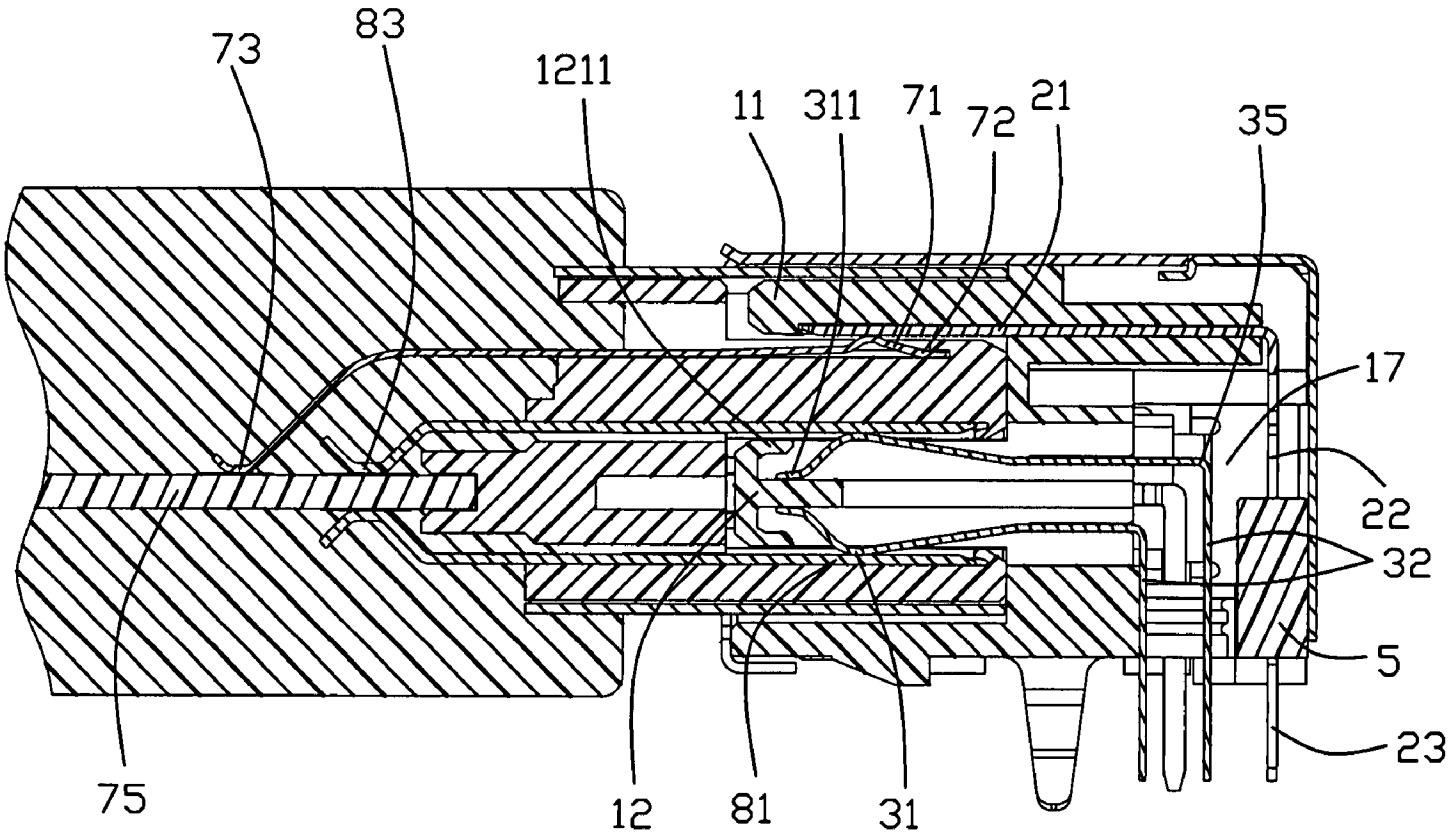
FIG. 11 is a cross-sectional view of the electrical plug and receptacle taken along line 11-11 of FIG. 10, showing contacts mating with each other.

In FIGS. 10 and 11, a mating status of the electrical plug 200 fully insertion into the electrical receptacle 100 is shown. After the electrical plug 200 is fully inserted into the electrical receptacle 100, all plug contacts 7, 8 physically contact corresponding contacts 2, 3 of the electrical receptacle 100 as clearly shown in FIG. 11. Since the electrical receptacle 100 is compatible to the existing standard B-type USB 2.0 plug 400, with insertion of the standard B-type USB 2.0 plug 400, only the second contacts 3 of the electrical receptacle 100 abut against the contacts 43 of the B-type USB 2.0 plug 400.

As shown in FIG. 12, with fully insertion of the electrical plug 200 into the electrical receptacle 100, the contact portions 85 of the plug power contacts 84 abut against the contact sections 242 of the corresponding power contacts 24 for voltage transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical receptacle, comprising:

an insulative housing defining an upper receiving cavity with an upper tongue portion extending thereinto and a lower receiving cavity communicating with the upper receiving cavity with a lower tongue portion extending thereinto, the upper and the lower tongue portions being parallel to each other while the lower tongue portion being thicker than the upper tongue portion;

a plurality of non-elastic first contacts disposed on a lower surface of the upper tongue portion, each first contact comprising a stiff first contacting portion exposed to the upper receiving cavity and a first mounting portion; and a plurality of deformable second contacts disposed on opposite upper and lower walls of the lower tongue portion, each second contact comprising a convex second contacting portion protruding into the lower receiving cavity; and a spacer fixed to the insulative housing in order to position the first mounting portions; wherein the lower receiving cavity is independently used for receiving a first insertion connector, and the upper and the lower receiving cavities are jointly used for receiving a second insertion connector expanding from the first insertion connector, wherein the first mounting portions bend downwardly from the corresponding second contact portions under a condition that the first contacting portions and the first mounting portions are located at horizontal and vertical planes, respectively, and the spacer defines a plurality of through holes through which the first mounting portions extend.

2. The electrical receptacle as claimed in claim 1, wherein the insulative housing comprises a pair of wings with a receiving slot formed therebetween to receive the spacer.

3. The electrical receptacle as claimed in claim 1, wherein the first contacts comprise tail portions formed at distal ends of the first mounting portions under a condition that the tail portions are contracted compared with the first mounting portions and downwardly extend beyond the spacer.

4. The electrical receptacle as claimed in claim 1, wherein one of the upper and the lower walls of the lower tongue portion defines a passageway to mount the corresponding second contact portion and a pressing plate extending into said passageway, the corresponding second contact portion further having an extension end located under the pressing plate so that the corresponding second contacting portion can be protected from over-extension beyond said passageway.

5. The electrical receptacle as claimed in claim 4, wherein the insulative housing comprises a base portion from which the upper and the lower tongue portions extend, said passageway further extending through the base portion, the second contact comprising a fastening portion extending from the second contacting portion, the fastening portion having a plurality of barbs interferentially abutting against said passageway for fixation.

6. The electrical receptacle as claimed in claim 5, wherein the base portion defines a rear chamber located at the rear of the lower tongue portion, the second contact comprising a second mounting portion downwardly bending from the fastening portion under a condition that a transition portion formed by the second mounting portion and the fastening portion is received in the rear chamber.

7. The electrical receptacle as claimed in claim 1, wherein the insulative housing comprises a chamfered portion located at an upper left corner of the lower receiving cavity for regulating insertion of the first and the second insertion connectors; and wherein the first insertion connector is a standard B-type USB 2.0 plug.

8. The electrical receptacle as claimed in claim 1, wherein the insulative housing comprises a pair of side extensions with the upper and the lower tongue portions located therebetween, each side extension comprising a front contracted section, the electrical receptacle comprising a front metal shield covering the side extensions, the front metal shield comprising a corresponding contracted portion covering the front contracted section of the insulative housing.

9. The electrical receptacle as claimed in claim 1, wherein the insulative housing comprises a top surface and a front mating surface through which the upper and the lower receiving cavities are recessed, a depression being downwardly defined through the top surface and further extending through the front mating surface so that an upper surface of the upper tongue portion is lower than the top surface.

10. The electrical receptacle as claimed in claim 1, further comprising a pair of power contacts disposed on opposite side walls of the lower tongue portion, each power contact comprising a retaining section, an elastic contact section extending forwardly from the retaining section, an offset section extending outwardly from the retaining section and a soldering section extending downwardly from the retaining section, each side wall defining a groove for receiving the elastic contact section, the retaining section and the soldering section being located at different planes.

11. An electrical plug comprising:

a frame-shaped insulator defining a lower mating cavity;

a metal shell enclosing the insulator to form an upper mating cavity restricted by the metal shell and the insulator under a condition that the upper mating cavity is narrower than the lower mating cavity, and the upper and the lower mating cavities are separated by a separated plate formed on the insulator, the separate plate comprising an upper mating surface through which a plurality of first passageways are defined and a lower mating surface, the metal shell comprising a slant portion substantially located at its middle position and also located adjacent to the lower mating cavity;

a plurality of first plug contacts having elastic first contacting sections deformably received in the first passageways and resistance ends extending from the first contacting sections under a condition that the resistance ends are always located below the upper mating surface in order to prevent the first contacting sections from over-extension beyond the upper mating surface; and a plurality of second plug contacts having stiff second contacting sections disposed on the lower mating surface of the separated plate and exposed to the lower mating cavity, wherein the insulator comprises a bottom portion opposite to the separate plate and a pair of side portions connecting the separate plate and the bottom portion, a lower mating cavity being enclosed by the separate plate, the pair of side portions and the bottom portion, and further comprising a pair of stiff shaped plug power contacts with contact portions mounted on the side portions of the insulator and exposed to the lower mating cavity, each side portion of the insulator comprising a block protruding into the lower mating cavity in order to position a distal end of the corresponding contact portion.

12. The electrical plug as claimed in claim 11, wherein the metal shell comprises a top wall, a pair of side walls partly abutting against the side portions of the insulator, and a bottom wall attached to the bottom portion of the insulator, the lower mating cavity being formed by the top wall, parts of the side walls and the separate plate.

13. The electrical plug as claimed in claim 11, wherein the second plug contacts comprise mounting sections extending from the stiff second contacting sections; and wherein the mounting sections are contracted compared with the corresponding stiff second contacting sections.

14. The electrical plug as claimed in claim 11, further comprising an inner PCB mounted in the insulator under a condition that the first and the second plug contacts are electrically connected with the PCB.

15. An electrical connector comprising:

a first connector including a first insulative housing and defining a first mating port with a first mating tongue forwardly extending in said first mating port, said first mating tongue defining a pair of first horizontal mating faces and a pair of first vertical mating faces alternately adjacent to each other;

two rows first horizontal contacts disposed in the first housing, each of said first horizontal contacts having a first deflectable contacting section exposed upon the corresponding first horizontal mating face; and a pair of first vertical contacts disposed in the first housing, each of said first vertical contacts having a first resilient contacting section exposed upon the corresponding first vertical mating face; wherein mounting sections of said pair of first vertical contacts are located by two sides of those of said two rows of first horizontal contacts, wherein said first housing further includes a second mating port with a second mating tongue therein with a plurality of first stiff contacts thereon, and wherein mounting sections of said first stiff contacts are laterally outwardly offset so as to comply with the mounting sections of the first vertical contacts in a front-to-back direction, wherein the mounting sections of said first horizontal contacts and those of said first vertical contacts and those of said first stiff contacts are arranged in at least three row along a transverse direction.

* * * * *